US010773275B2

(12) United States Patent
Brutinel et al.

(10) Patent No.: US 10,773,275 B2
(45) Date of Patent: Sep. 15, 2020

(54) PROCESS FOR DEPOSITING DRY POWDER PARTICLES ONTO A SUBSTRATE AND ADHESIVELY BONDING THE PARTICLES TO THE SUBSTRATE

(71) Applicant: 3M INNOVATIVE PROPERTIES COMPANY, St. Paul, MN (US)

(72) Inventors: Evan D. Brutinel, Inver Grove Heights, MN (US); Jon E. Dable, Lakeville, MN (US); Shawn C. Dodds, St. Paul, MN (US); Ann M. Gilman, Woodbury, MN (US); Matthew R. D. Smith, Woodbury, MN (US); Matthew S. Stay, Minneapolis, MN (US); Eric A. Vandre, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/063,460

(22) PCT Filed: Dec. 16, 2016

(86) PCT No.: PCT/US2016/067121

§ 371 (c)(1),
(2) Date: Jun. 18, 2018

(87) PCT Pub. No.: WO2017/106613

PCT Pub. Date: Jun. 22, 2017

(65) Prior Publication Data

US 2019/0001369 A1 Jan. 3, 2019

Related U.S. Application Data

(60) Provisional application No. 62/269,711, filed on Dec. 18, 2015.

(51) Int. Cl.
*B05D 1/32* (2006.01)
*B05C 9/02* (2006.01)
(Continued)

(52) U.S. Cl.
CPC ..... *B05D 1/32* (2013.01); *B05C 9/025* (2013.01); *B05D 1/28* (2013.01); *B05D 7/04* (2013.01);
(Continued)

(58) Field of Classification Search
CPC ..... B05D 1/32; B05D 2401/32; B05C 9/025; B24D 18/0072
See application file for complete search history.

(56) References Cited

U.S. PATENT DOCUMENTS 2,152,077 A 3/1939 Meston
3,426,730 A 2/1969 Lawson
(Continued)

FOREIGN PATENT DOCUMENTS

CH 550070 A 6/1974
EP 1755893 2/2007
(Continued)

OTHER PUBLICATIONS

"Encyclopedia of Polymer Science and Engineering", Wiley-Interscience Publishers New York, 1988, vol. 13, 3pgs.
(Continued)

*Primary Examiner* — Alex A Rolland
(74) *Attorney, Agent, or Firm* — Kenneth B. Wood

(57) ABSTRACT

Methods for using a hollow, rotating stencil roll to deposit flowable dry powder particles onto a moving substrate and to adhesively bond the particles to a pressure-sensitive adhesive surface of the substrate.

20 Claims, 5 Drawing Sheets

(51) Int. Cl.
*B05D 1/28* (2006.01)
*B05D 7/04* (2006.01)

(52) U.S. Cl.
CPC ..... *B05D 2201/02* (2013.01); *B05D 2252/02* (2013.01); *B05D 2401/32* (2013.01)

(56) References Cited

U.S. PATENT DOCUMENTS 3,836,367 A * 9/1974 Klemm ..... G03F 7/12 430/308
4,054,697 A * 10/1977 Reed ..... B44C 1/105 428/41.8
4,167,975 A * 9/1979 Fahrenholz ..... E01H 12/00 171/12
4,930,266 A * 6/1990 Calhoun ..... B24D 11/001 51/293
5,612,081 A 3/1997 Orr et al.
5,975,988 A * 11/1999 Christianson ..... B24D 3/002 451/28
6,155,165 A 12/2000 Kaule
6,500,520 B1 * 12/2002 Wiercinski ..... C09J 7/381 428/150
7,442,480 B2 10/2008 Kanamaru
2004/0018802 A1 * 1/2004 Welygan ..... B24D 3/002 451/28
2004/0112231 A1 6/2004 Mori
2005/0034621 A1 2/2005 McNeil
2005/0118939 A1 * 6/2005 Duescher ..... B24D 11/00 451/527
2010/0035377 A1 2/2010 Gobrogge et al.
2010/0080896 A1 4/2010 Bachmann
2011/0063374 A1 3/2011 Rea
2011/0252987 A1 10/2011 Cibula
2012/0183684 A1 7/2012 Aschenbeck
2015/0191005 A1 7/2015 Berger et al.
2015/0232646 A1 8/2015 Walker, Jr.
2015/0337592 A1 11/2015 Rubinoff

FOREIGN PATENT DOCUMENTS

GB 1236995 A 6/1971
WO WO 2013/171366 A2 11/2013
WO WO 2014-012700 A1 1/2014
WO WO 2015-123526 8/2015
WO WO 2016-196795 A1 12/2016
WO WO 2017-106098 6/2017

OTHER PUBLICATIONS

"The Industrial Solutions Company", [online], [retrieved from the internet on Aug. 16, 2018], URL <http://www.tps-technopartner.de/english/?Scattering_units:Scattering_with_rotary_screen>, 2 pgs.
Satas, Handbook of Pressure-Sensitive Adhesive Technology, 172-173 (1989).
Extended European Search Report, EP16876753.1, dated Jul. 4, 2019, 3 pages.

* cited by examiner

PROCESS FOR DEPOSITING DRY POWDER PARTICLES ONTO A SUBSTRATE AND ADHESIVELY BONDING THE PARTICLES TO THE SUBSTRATE

BACKGROUND

Particles are often disposed on substrates for a variety of purposes, for example as spacers, to produce retroreflective articles, to produce abrasive articles, to produce scratch and sniff articles, and so on.

SUMMARY

In broad summary, herein are methods for using a hollow, rotating stencil roll to deposit flowable dry powder particles onto a moving substrate and to adhesively bond the particles to a pressure-sensitive adhesive surface of the substrate. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
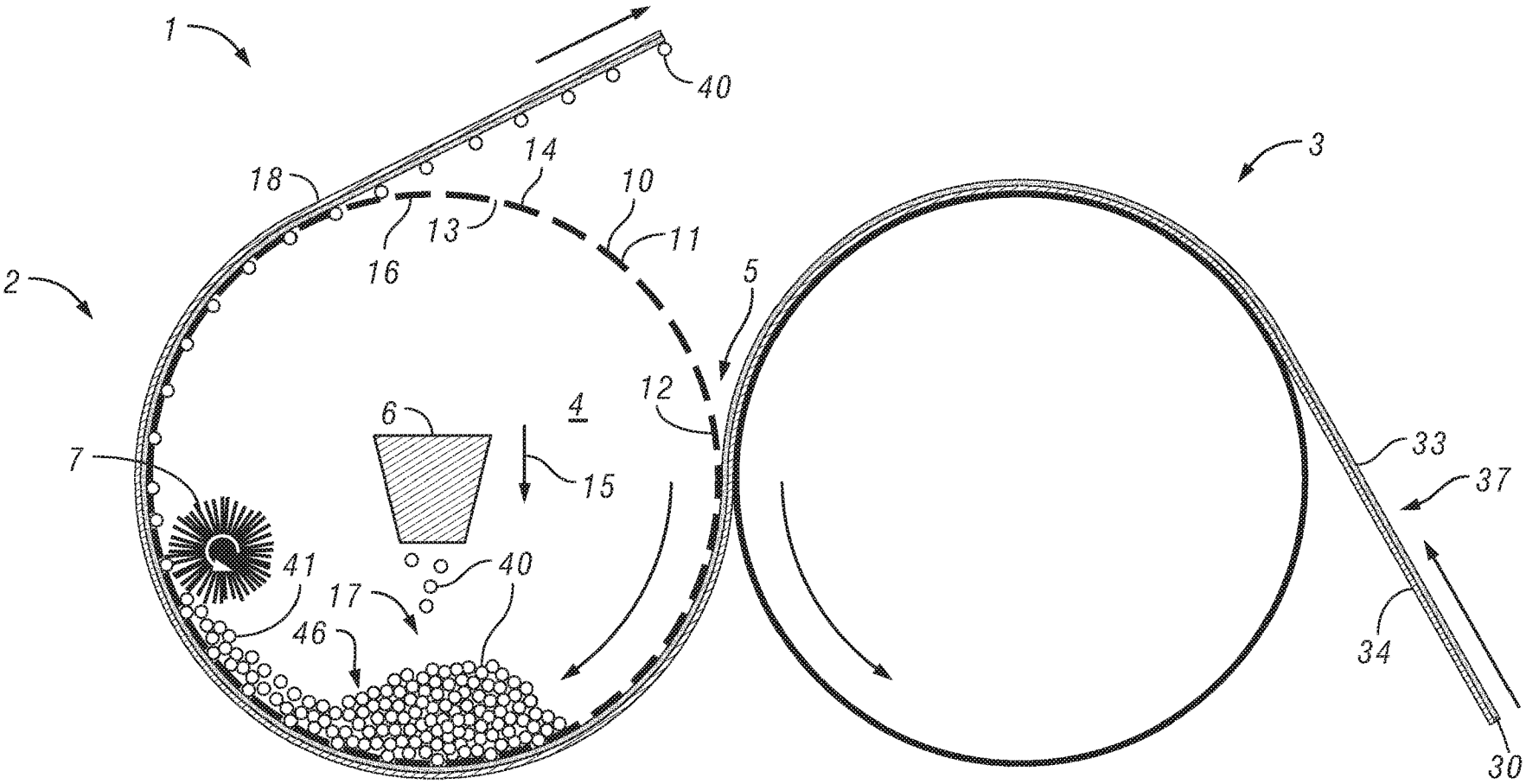
FIG. 1 is a side schematic cross sectional view of an exemplary apparatus and process that can be used to deposit flowable dry powder particles onto a moving substrate.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Terms such as "top", bottom", "upper", lower", "under", "over", "up" and "down", and the like, are used in their conventional sense with respect to the Earth's gravity.

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). For angular orientations, the term "generally" means within clockwise or counterclockwise 30 degrees. The term "substantially", unless otherwise specifically defined, means to a high degree of approximation (e.g., within +/−10% for quantifiable properties). For angular orientations, the term "substantially" means within clockwise or counterclockwise 10 degrees. The term "essentially" means to a very high degree of approximation (e.g., within plus or minus 1% for quantifiable properties; within plus or minus 2 degrees for angular orientations); it will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. Those of ordinary skill will appreciate that as used herein, terms such as "essentially free of", and the like, do not preclude the presence of some extremely low, e.g. 0.1% or less, amount of material, as may occur e.g. when using large scale production equipment subject to customary cleaning procedures. All references herein to numerical parameters (dimensions, ratios, and so on) are understood to be calculable (unless otherwise noted) by the use of average values derived from a number of measurements of the parameter.

DETAILED DESCRIPTION

Glossary

By flowable dry powder particles is meant particles that are at least substantially free of liquid and that can flow freely in a dry state, e.g. as motivated by gravity. Specifically, by dry powder is meant that the particles are in the form of a conventional powder rather than as a dispersion, suspension, paste, plastisol, emulsion or the like in a liquid. The term dry does not imply that the particles must be completely free of trace amounts of moisture as may be typically present in many powders.

By dispersing is meant passively distributing flowable dry powder particles under the influence of e.g. gravity. Dispersing does not encompass active particle transfer and/or deposition methods such as spraying, electrostatic coating, and the like.

By a stencil roll is meant a roll comprising a shell comprising a plurality of through-apertures that extend therethrough in a predetermined pattern, so that flowable dry powder particles can pass through the through-apertures.

By a pressure-sensitive adhesive is meant a material that meets the Dahlquist criterion as described in the Handbook of Pressure-Sensitive Adhesive Technology, D. Satas, $2^{nd}$ ed., page 172 (1989). This criterion defines a pressure-sensitive adhesive as a material having a one-second creep compliance of greater than $1\times10^{-6}$ $cm^2$/dyne at its use temperature (for example, at temperatures in a range of from 15° C. to 35° C.). The ordinary artisan will know that pressure-sensitive adhesives are normally tacky at room temperature and can be adhered to a surface by application of, at most, light finger pressure and thus may be distinguished from other types of adhesives that are not pressure-sensitive. A general description of pressure-sensitive adhesives may be found in the Encyclopedia of Polymer Science and Engineering, Vol. 13, Wiley-Interscience Publishers (New York, 1988).

By an array is meant a population of dry powder particles disposed on (e.g., attached to) a substrate in a pattern (which pattern may be e.g. regular or irregular).

Shown in side schematic cross sectional view in FIG. 1 is an exemplary apparatus 1 and method that can be used to deposit flowable dry powder particles 40 onto a moving substrate 30. The method relies on a hollow, rotating stencil roll 2 that rotates about an axis of rotation and that has a major radially outer surface 11 and a major radially inner surface 12. Flowable dry powder particles 40 are dispersed within interior 4 of stencil roll 2 by particle dispenser 6. Particles 40 are dispensed onto the radially inner major surface 12 of stencil roll 2, e.g. landing on a lowermost angular portion (e.g. quadrant) of major surface 12 of stencil roll (noting that this encompasses cases in which flowable dry powder particles are deposited onto/into a loose mass of already-present flowable dry powder particles located at least in a lowermost angular portion 17 of interior 4 of stencil roll 2, rather than each particle necessarily landing directly on major surface 12 of stencil roll 2). In some embodiments, the particles are gravity-dropped, meaning that they are released from dispenser 6 so as to fall freely under the influence of gravity, with no other force being imparted on the particles as they leave dispenser 6.

As stencil roll 2 rotates, a substrate 30 (e.g., a sheetlike material such as a tape backing) is brought toward stencil roll 2 so that a first major surface 33 of a first side 37 of the substrate is contacted with major radially outer surface 11 of stencil roll 2. (In some embodiments, this may be assisted by a backing roll 3, which can abut stencil roll 2 so as to form nip 5 therebetween, as in the design of FIG. 1). With radially outer surface 11 of stencil roll 2 and substrate 30 moving at the same speed along an arcuate path (so that there is essentially no slippage of substrate 30 relative to surface 11 of stencil roll 2 along the direction of motion of the two items), at least one flowable dry powder particle 40 will enter one through-aperture 13 of stencil roll 2 and pass therethrough so as to contact first major surface 33 of substrate 30. First side 37 (e.g., first major surface 33 thereof) of substrate 30 is configured so that a flowable dry powder particle 40 is attachable thereto, as described later herein in detail. Thus, as stencil roll 2 and substrate 30 follow an arcuate path, particles are distributed into through-apertures 13 and contact, and become attached to, first major surface 33 of substrate 30, e.g. as depicted in FIG. 1. Substrate 30 is separated from stencil roll 2 at separation point 18, to produce a substrate 30 comprising an array of flowable dry powder particles 40 attached to first side 37 of substrate 30.

Tumbling Freely

In many embodiments, an excess of flowable dry powder particles (i.e., a "hold-up" particle population 46) may be present e.g. in the lowermost portion (e.g. quadrant) 17 of interior 4 of stencil roll 2 (such particles, after being dispensed by particle dispenser 6, will be motivated toward that location by the Earth's gravity, indicated by arrow 15 of FIG. 1). By excess is meant that significantly more particles are present in this portion of interior 4 of stencil roll 2 than can be accommodated by the area of major surface 33 of substrate 30 that is exposed through-apertures 13 of this portion of stencil roll 2. In at least some embodiments, such "hold-up" flowable dry powder particles are able to tumble freely within interior 4 of stencil roll 2 (motivated by the Earth's gravity) as stencil roll 2 rotates. By tumbling freely is meant that as stencil roll 2 continuously rotates, at any given time at least five percent of the particles in the hold-up population 46 of particles within interior 4 of stencil roll 2 are moving (motivated by the Earth's gravity) with respect to inner surface 12 of stencil roll 2, along a path approximately locally parallel to inner surface 12 of stencil roll 2. By tumbling freely is further meant that at least half of these moving particles are not simply sliding individually along inner surface 12 of stencil roll 2 (e.g. as a monolayer of particles) as roll 2 rotates; rather, numerous particles are present in stacks of two, three or more (e.g., considerably more) particles in depth, and encounter and collide with each other and mix with each other as they move relative to inner surface 12 of stencil roll 2.

The ability of flowable dry powder particles 40 to tumble freely can be enhanced by providing that no components such as interior walls, partitions or baffles are present in interior 4 of stencil roll 2, in spaces in close proximity to inner surface 12 of stencil roll 2 and in such manner that the components would prevent the particles from tumbling freely. Thus in at least some embodiments, operating the herein-disclosed method so that the particles tumble freely excludes any such components from being present within interior 4 of stencil roll 2. Such exclusions do not preclude e.g. supporting structural members and other ancillary items that may be present within interior 4 of stencil roll 2, as long as such items do not prevent the particles from freely tumbling. Nor is it necessarily required that inner surface 12 of stencil roll 2 must be perfectly smooth. For example, in some embodiments "lips" (which may sometimes be present in the case of through-apertures that are produced by mechanical punching or the like) may be present at or near the inner ends of at least some through-apertures 13. Such exclusions also do not preclude the use of a stencil roll that comprises a screen-printing screen (as discussed later in detail), which screen may take the form of a woven mesh that will inherently exhibit slight variations in the topography of the inner surface thereof.

It will be appreciated that in order to operate apparatus 1 so that at last some of the flowable dry powder particles freely tumble as described above, it may not necessarily be sufficient to omit such components (e.g., partitions or baffles within the interior of stencil roll 2) as would obviously prevent free tumbling. Rather, various operating parameters (e.g. the angular speed of rotation of stencil roll 2 in combination with the diameter of stencil roll 2, the rate of dispensing of particles 40 into the interior of stencil roll 2, and the volume of hold-up population 46 of particles that are maintained within the interior of the stencil roll) may be set in particular ranges in order to provide that the particles freely tumble in operation of the method, as will be appreciated by the ordinary artisan. It will also be appreciated that the conditions under which free tumbling is present may in some instances depend on certain properties of the particles themselves (e.g. static charge) as well as the environment in general (e.g., relative humidity). The ordinary artisan will understand that all such particle properties, process parameters and general conditions, can be chosen in order that the flowable dry powder particles freely tumble during operation of the process.

In particular embodiments, at least some of the freely tumbling flowable dry powder particles 40 of hold-up population 46 may form a readily identifiable "rolling bank" 41 (such a rolling bank is akin to the rolling banks encountered in various types of liquid coating operations; as such, this term will be readily understood by the ordinary artisan).

It will be appreciated that allowing the hold-up particle population 46 to tumble freely within the interior of stencil roll 2 can serve to keep particles 40 uniformly mixed and in particular can minimize any stratification of the hold-up particle population 46 into larger and smaller sized particles. Allowing the hold-up dry powder particles to form a rolling bank may be particularly effective in this regard. Still further, allowing the hold-up particle population 46 to tumble freely, e.g. to form a rolling bank, may enhance the degree to which the particles are uniformly spread along the long axis of the stencil roll.

In some embodiments, apparatus 1 may include at least one particle-contacting member 7 that at least closely abuts (and may actually touch) major radially inner surface 12 of stencil roll 2 but is not attached to stencil roll 2 so as to rotate along with stencil roll 2. Member 7 may assist in dislodging at least some flowable dry powder particles 40 from the major radially inner surface 12 of the stencil roll (e.g. overcoming any static friction forces and/or slight electrostatic forces that might tend to keep particles 40 in place on a given location of inner surface 12) so that the particles can tumble freely within interior 4 of stencil roll 2 as stencil roll 2 rotates. At the same time, member 7 avoids dislodging any particles that have traveled into through-apertures 13 so as to contact and bond to substrate 30. Thus, in specific embodiments, any particles 40 that have traveled into and through apertures 13 and have bonded to substrate 30, are not dislodged or removed from substrate 30, either by gravity or by member 7. It will be appreciated that this can enhance the fidelity with which the particles are deposited and retained on the substrate in a desired pattern.

Member 7 may have any suitable design although it may conveniently exhibit a long axis that is at least generally parallel to the long axis (e.g., the axis of rotation) of stencil roll 2. In some embodiments, member 7 may comprise a plurality of fibers, filaments, bristles or the like. In some specific embodiments, member 7 may comprise at least one brush. In other specific embodiments, member 7 may comprise a fibrous surface (e.g., analogous to a paint roller). In still other embodiments, member 7 may take the form of, e.g. a scraper, blade, squeegie, or like item. In various embodiments, such a member may be non-moving; or, it may rotate in a direction opposite the direction of rotation of stencil roll 2 or in the same direction as stencil roll 2. Such a member may also be oscillated (e.g. rotationally and/or longitudinally) rather than rotated continuously. In various embodiments, a member 7 may be positioned at an angular distance, along the direction of rotation of the stencil roll, of from about 30 degrees to about 100 degrees from a gravitationally lowest point of the stencil roll. (By way of specific example, member 7 of FIG. 1 is mounted at an angular distance of about 80 degrees from the gravitationally lowest point 17 of stencil roll 2.)

In some embodiments, member 7 may be configured to (either in addition to, or instead of, dislodging flowable dry powder particles 40 from the major radially inner surface 12 of the stencil roll) assist in motivating flowable dry powder particles to move radially outward through apertures 13 and/or urging such particles against first major surface 33 of substrate 30 to be bonded thereto. (Depending on the amount of radially outward pressure that might be imparted on stencil roll 2 by such a member, a backing roll can be placed radially outward of stencil roll 2 at that location to provide appropriate balancing of forces if desired.)

In some embodiments (whether or not a member 7 is present) apparatus 1 does not include any sort of mechanical device that periodically vibrates, strikes or taps stencil roll 2 (e.g., radially outer surface 11 thereof) to dislodge particles from radially inner surface 12 thereof. In other embodiments, stencil roll 2 may be vibrated or tapped at a desired location (e.g. between the 9 o'clock and 11 o'clock positions of a stencil roll of the type shown in FIG. 1) to enhance the dislodging of particles from radially inner surface 12 thereof.

In some embodiments, after substrate 30 has become separated from stencil roll 2, moving air may be impinged on major surface 33 of substrate 30 in order to promote the removal of any particles 40 that may be resting on major surface 33 (and/or resting atop other particles 40) without having become securely bonded to major surface 33. In addition to this, or instead of this, moving air may be removed from the vicinity of substrate 30 so that any particles that might be entrained in the air may be prevented from undesirably contacting major surface 33. Such moving air may be provided by any suitable arrangement, e.g. one or more air knives, vacuum hoses or shrouds, and so on. In other embodiments, no moving air of any kind may be used in such manner.

Figure 2:
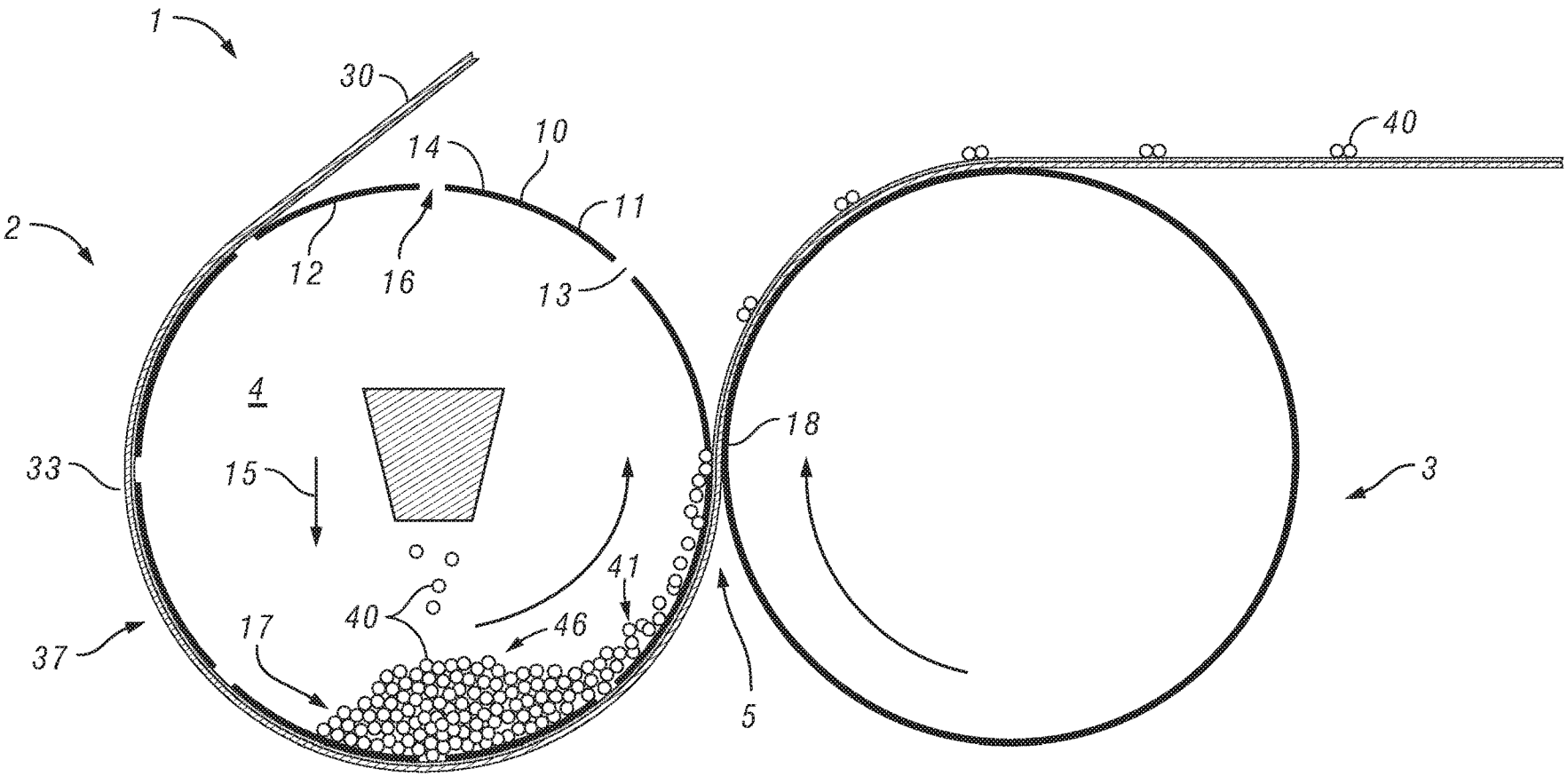
FIG. 2 is a side schematic cross sectional view of another exemplary apparatus and process that can be used to deposit flowable dry powder particles onto a moving substrate.

FIG. 2 depicts in exemplary embodiment an arrangement of a particle deposition apparatus and method that differs slightly from that of FIG. 1. In the embodiment of FIG. 2, the incoming substrate 30 is wrapped against the radially outer surface 11 of stencil roll 2, at a free location of roll 2 rather than at a nip as in FIG. 1. In this design, the separation point 18 at which substrate 30 is detached from surface 11 of roll 2, is at nip 5 between stencil roll 2 and a backing roll 3. Also, no particle-contacting member is present in the exemplary design of FIG. 2. Otherwise, the descriptions above all apply to the apparatus and method shown in FIG. 2.

The contact point at which substrate 30 is first contacted with surface 11 of stencil roll 2 (whether such a contact point is proximate a nip 5 as in the design of FIG. 1, or is along a free portion of roll 2 as in the design of FIG. 2), may be located at any suitable angular location along the arcuate path of surface 11 of roll 2. In various embodiments, such a contact point may be located at between a 9 o'clock and a 3 o'clock position (using conventional terminology with 12 noon signifying an uppermost position 16 of stencil roll 2), or between a 10 o'clock and a 2 o'clock position when viewed as in FIG. 1. In specific embodiments, such a contact point is positioned so that substrate 30 is traveling in a downward direction at the contact point (as in FIGS. 1 and 2).

The separation point 18 at which substrate 30 is detached from surface 11 of stencil roll 2, may be located at any suitable angular location along the arcuate path of surface 11 of roll 2. In various embodiments, the separation point 18 may be located at between a 9 o'clock and a 3 o'clock position (using conventional terminology with 12 noon signifying an uppermost position 16 of stencil roll 2), or between a 10 o'clock and a 2 o'clock position when viewed as in FIG. 1. In specific embodiments, separation point 18 is positioned so that substrate 30 is traveling in an at least generally upward direction at the separation point.

The concept of first major surface 33 of substrate 30 "contacting" radially outer surface 11 of stencil roll 2, by definition requires that there is essentially no slippage of substrate 30 relative to surface 11 of stencil roll 2 along the direction of motion of surface 11 and surface 33 during the time that substrate 30 is in contact with stencil roll 2. This can advantageously ensure that particles are not deposited on surface 33 of substrate 30 so as to exhibit a "comet tail" e.g. along the direction of movement of the substrate. Furthermore, in some embodiments, essentially all particles 40 that are not attached to surface 33 of substrate 30 may be dislodged from radially inner surface 12 of stencil roll 2 (e.g. by the Earth's gravity, by way of particle-contacting member 7, or by some combination thereof) and tumble freely away from that area of surface 12, before substrate-roll separation point 18 is reached. This can additionally ensure that very few loose particles may inadvertently be expelled through apertures 13 so as to reach substrate 30 in the short time after substrate 30 is separated from stencil roll 2 but is still relatively close thereto. In other words, the arrangements disclosed herein can provide that, in some embodiments, the flowable dry powder particles are contacted with (and attached to), essentially only the specific areas of surface 33 of substrate 30 that were in overlapping relation with through-apertures 13 of stencil roll 2. This again can minimize any inadvertent spreading, spraying or smearing of the particles and can allow the particles to be deposited on substrate 30 in a very well-controlled array if desired. Thus in various embodiments, less than about 50, 30, 20, 10, or 5% by number of the flowable dry powder particles are attached to areas of first major surface 33 of substrate 30 that had come into contact with (land areas 14 of) radially outer major surface 11 of stencil roll 2 (as opposed to being attached to areas that were in overlapping relation with through-apertures 13 of stencil roll 2).

Figure 3:
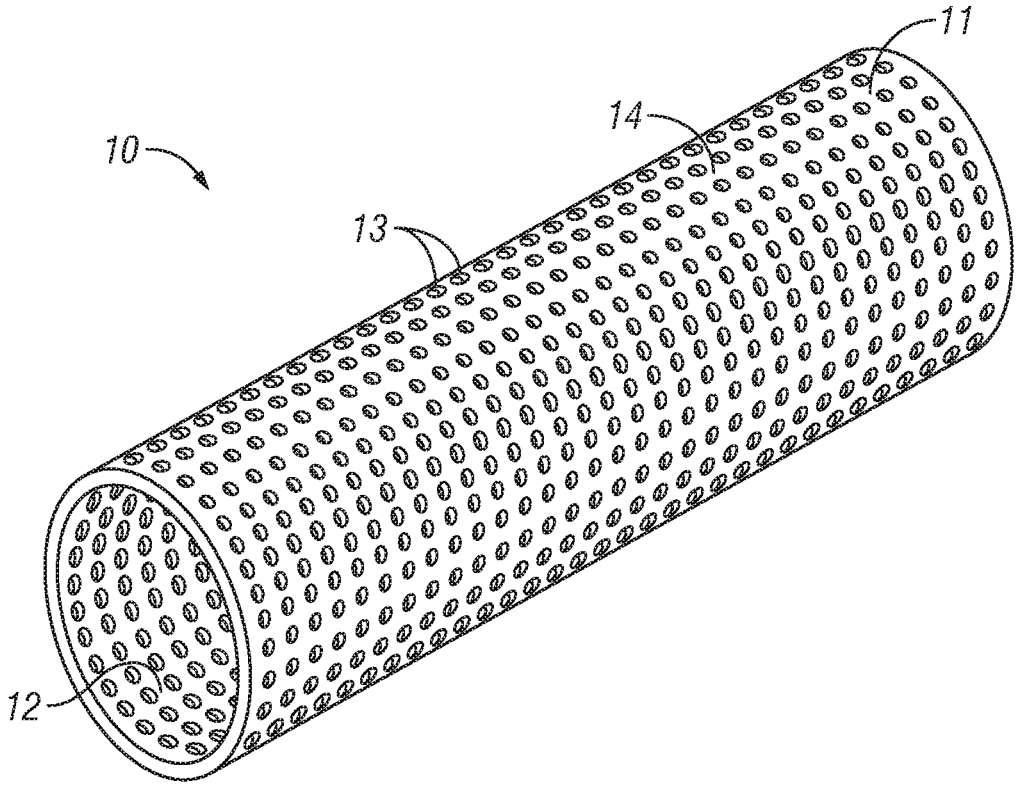
FIG. 3 is a side perspective view of an exemplary stencil shell of a stencil roll.

In some embodiments stencil roll 2 may rely on a stencil shell (e.g., a metal sleeve, such as a nickel sleeve, that slips onto a support grid) 10 of the general type depicted in FIG. 3. Shell 10 may be supported by any suitable interior frame or set of support members that allow flowable dry powder particles to be distributed to radially inner surface 12 of shell 10. In embodiments in which shell 10 is sufficiently strong and rigid, shell 10 may be supported mainly, or essentially completely, by endcaps or endrings to which longitudinal ends of shell 10 are attached so as to form stencil roll 2. Shell 10 may comprise numerous through-apertures 13, separated from each other by land areas 14 (which will provide the radially outermost surface of stencil roll 2 against which the major surface 33 of substrate 30 is contacted). Through-apertures 13 may be provided in any desired pattern and shape and may be of any suitable size (i.e. diameter or equivalent diameter in the case of apertures that are not circular). In many embodiments the radial thickness (along a radially inward-outward direction) of such apertures may be set by e.g. the thickness of a stencil shell 10. This thickness may be chosen in relation to the size of the particles (and other aperture parameters such as size and shape may also be chosen) e.g. to govern the rate at which particles can be passed therethrough.

In some embodiments, at least selected apertures of the stencil roll may be configured (e.g. to have a particular size and/or shape and/or length) so that flowable dry powder particles can pass through each selected aperture only one at a time, so that for each complete rotation of the stencil roll, only one flowable dry particle is passed through each selected aperture to be attached to the major surface of the substrate. (An idealized representation of such an arrangement is depicted in FIG. 1.) In other embodiments, at least selected apertures of the stencil roll may be configured so that multiple dry powder particles can pass through each selected aperture at a time, so that for each complete rotation of the stencil roll, multiple flowable dry powder particles are passed through each selected aperture to be attached to the major surface of the substrate. (An idealized representation of an arrangement in which two particles are passed through each aperture for each rotation of the stencil roll is depicted in FIG. 2.). In further embodiments, at least selected apertures may be configured so that a substantial number of particles (e.g., 4, 6, 10, 20, 40 or more) are passed through each selected aperture during a complete rotation of the stencil roll.

Regardless of the particular arrangement, in at least some embodiments the aperture parameters may be chosen, and the operating parameters of the method likewise chosen, to provide that substantially or essentially all particles 40 that enter an aperture 13 but are not attached to surface 33 of substrate 30, are dislodged from the aperture (e.g. by the Earth's gravity, by way of particle-contacting member 7, or by some combination thereof) so as to tumble freely away from the aperture, before substrate-roll separation point 18 is reached. In other words, in at least such embodiments the apertures do not function as "pockets" within which particles that are not attached to surface 33 of substrate 30 may nevertheless remain in place in the aperture as the drum rotates.

The radial length (e.g., as dictated by the radial thickness of a shell 10) of apertures 13 may be e.g. from about 20 μm to about 4 mm. In further embodiments, the radial length is at least about 50 μm, or 0.1, 0.2, 0.4, 0.6, 0.8, or 1.0 mm. In additional embodiments, the radial length is at most about 3.0, 2.5, 2.0, 1.5, or 1.0 mm. In some embodiments apertures 13 may be tapered with a wide portion and a narrower throat. In such cases, the length of the throat can be any of the above values. In various embodiments, the shape of apertures 13 may be e.g. circular, square, rectangular, irregular, and so on, as desired. In various embodiments, the size of apertures 13 may be from about 20 μm to about 100 mm in diameter (or equivalent diameter). In various embodiments, apertures 13 exhibit a diameter of at least about 50 μm, or 0.1, 0.2, 0.4, 0.8, or 1.0 mm; in further embodiments, apertures 13 exhibit a diameter of at most about 40, 20, 10, 3.0, 2.0, 1.0, 0.8, 0.6, or 0.4 mm.

The apertures may be present in any desired pattern and spacing over any desired portion of stencil roll 2. Such a pattern may be regular (e.g., a square array or hex array) or irregular as desired. The apertures may occupy any desired percentage of the total working surface area of stencil roll 2. In various embodiments, the apertures may occupy at least about 5, 10, 20, 30, or 40% of the total working surface area of roll 2. In further embodiments, the apertures may occupy at most about 70, 60, 50, 40, 30, 20, 10, or 5% of the total working surface area. In some embodiments, apertures 13 may be present as a mixture of different shapes, sizes, spacings, and so on.

Figure 4:
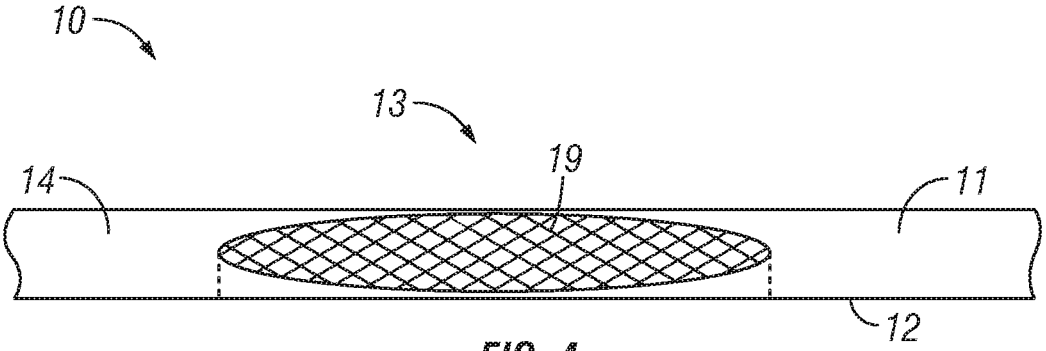
FIG. 4 is a perspective, isolated view of a portion of an exemplary stencil shell with apertures comprising sub-apertures.
Figure 6:
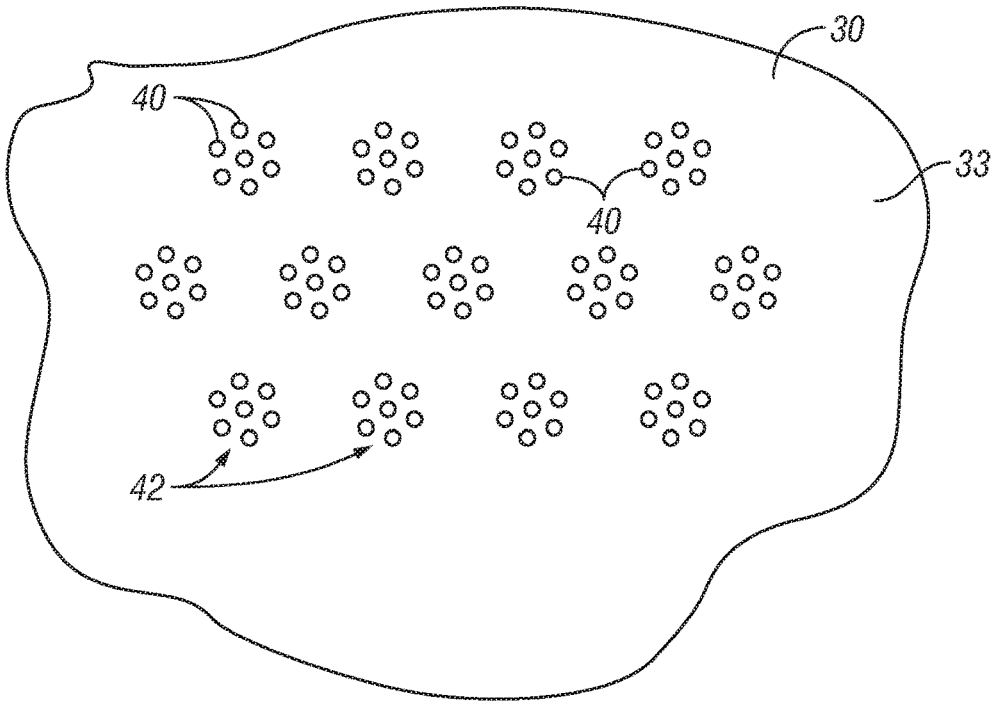
FIG. 6 is a top view of an exemplary substrate with flowable dry particles attached thereto, the dry powder particles being present on the substrate as a nested array.

In some embodiments, at least some apertures 13 of stencil roll 2 may each comprise a plurality of sub-apertures, at least selected sub-apertures being sized so as to allow at least one flowable dry powder particle 40 to pass therethrough at a time, so that the method causes a plurality of flowable dry powder particles 40 to be attached to the major surface of the substrate as a nested array. Such an arrangement is depicted in exemplary embodiment in FIG. 4, which depicts an isolated view of a portion of a stencil roll shell 10 containing an aperture 13. Aperture 13 comprises sub-apertures 19 (which may be defined by any suitable sheetlike material with sub-apertures extending therethrough; e.g. a microperforated metal screen or the like). It will be appreciated that the use of an aperture with sub-apertures in this manner can allow flowable dry powder particles 40 to be deposited to form patterns such as shown in exemplary manner in FIG. 6. Such patterns will be known as a nested array, in which individual particles 40 are grouped into clusters 42 (each cluster being comprised of particles 40 that passed through sub-apertures of a particular aperture), with the arrangement of the individual particles 40 in each cluster 42 being dictated by the pattern of the sub-apertures.

In particular embodiments in which apertures comprise sub-apertures, the apertures may be macroscopically sized in order to deposit flowable dry particles onto a substrate in large-scale pattern e.g., with desired overall shapes and sizes. For example, activated carbon particles might be deposited onto a filtration web in a macroscopic pattern in which particles are present in filtration areas but are absent in areas in which the web is to be e.g. ultrasonically bonded to components of a respirator mask. Thus at least in such embodiments, the apertures of stencil roll 2 may have a minimum size, along at least one dimension, of at least about 5 mm, 10 mm, or 2, 4, 6, or 8 cm.

Figure 5:
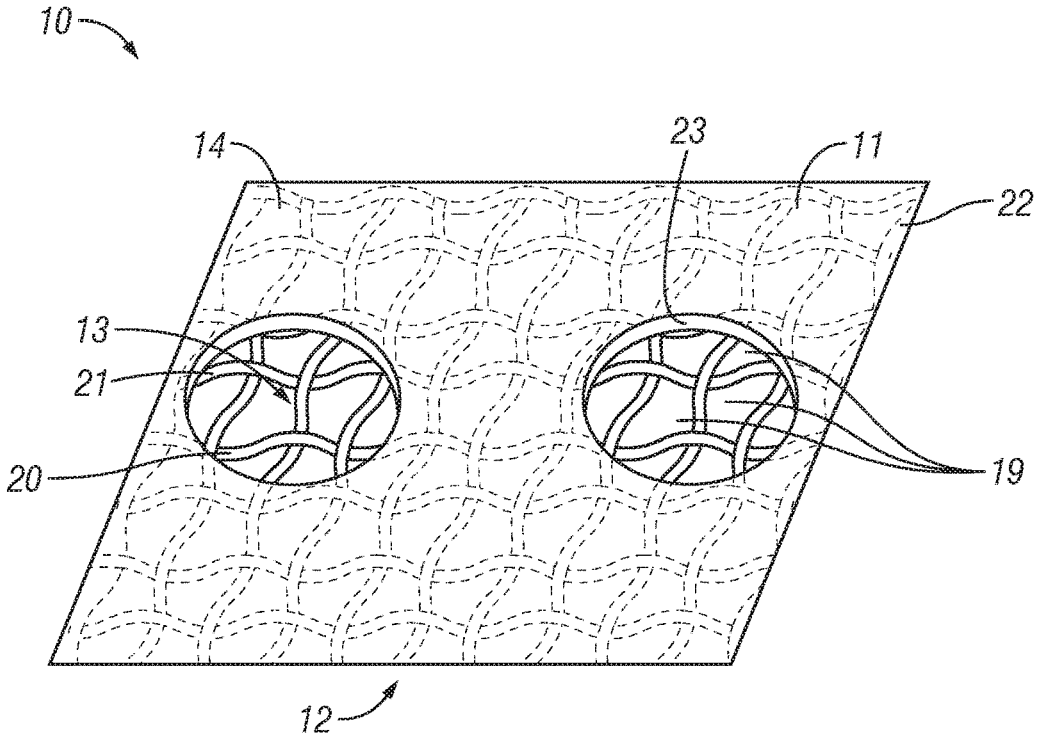
FIG. 5 is a perspective, isolated view of a portion of another exemplary stencil shell with apertures comprising sub-apertures.

Still another exemplary arrangement is shown in FIG. 5. It has been found that a screen-printing screen may suitably serve as a stencil shell 10 of a stencil roll 2. Many such screen-printing screens rely on a mesh screen 20 comprised of filaments 21. A hardenable material (e.g. a photoemulsion) 22 is coated on the mesh screen except in areas where it is desired to preserve permeability, and is hardened. A hardened emulsion 22 can comprise interior edges 23 that define areas of the screen-printing screen 20 that do not have hardened emulsion thereon, which areas provide apertures 13 of stencil shell 10. It will be appreciated that such an approach can inherently provide a stencil roll shell with apertures 13 that include sub-apertures 19 (as defined by the openings between filaments 21). However, in some specific embodiments, stencil roll 2 does not comprise a screen-printing screen.

In at least some embodiments, it has been found advantageous for outer surface 11 of stencil roll 2 (e.g., of shell 10) to exhibit release properties (specifically, in the land areas 14 that are interspersed between apertures 13). Any suitable release coating, treatment, or the like may be used. Such a release coating or treatment might rely on e.g. silicone materials, hydrocarbon materials, diamond-like carbon materials, fluorinated materials such as poly(tetrafluoroethylene), or the like. Such release properties may be achieved by coating (e.g., of a liquid-borne coating solution or dispersion); or, by any other suitable method of deposition. In the present work it has also been found that at least some hardened screen-printing emulsions can exhibit adequate release properties, without any specific treatment or coating being necessary thereon.

Substrate 30 may be comprised of any suitable material or materials and may take any suitable form. In some embodiments, substrate 30 may be a continuous substrate, e.g. a web (e.g., film, foil, nonwoven, and so on) that is supplied from a roll. In other embodiments, substrate 30 may be a discontinuous substrate, e.g. that is sheet-fed rather than roll-fed.

Figure 7:
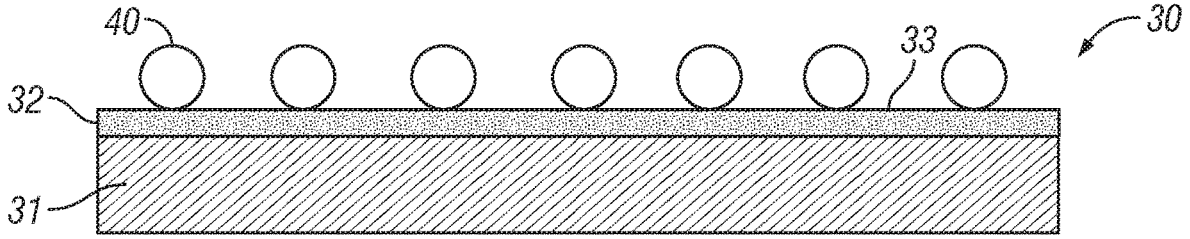
FIG. 7 is a side schematic cross sectional view of an exemplary substrate with flowable dry powder particles adhesively bonded thereto.

Substrate 30 may conveniently comprise a first, pressure-sensitive adhesive (PSA) layer 32 that is disposed on a second, backing layer 31. PSA layer 32 may include a major adhesive surface 33 to which flowable dry powder particles 40 are to be adhesively bonded (as well as a second, oppositely-facing major surface that is bonded to a major surface of backing 31), as shown in idealized representation in FIG. 7. Pressure-sensitive adhesive 32 can be of any suitable composition, e.g. based on (meth)acrylates, natural rubber, silicone, and so on, and can include one or more elastomers and/or tackifying agents and so on, as will be familiar to the ordinary artisan. In some embodiments, at the time that major surface 33 is contacted with the surface of the stencil roll in order for particles to be adhesively bonded thereto, pressure-sensitive adhesive layer 32 may already exhibit its final properties (e.g., any or all of mechanical strength, peel strength, shear strength, tack, and so on). In other embodiments, pressure-sensitive adhesive layer 32 may be of a composition such that after dry flowable particles are adhesively bonded thereto, the composition may be subjected to a secondary process (e.g. irradiation and/or heat to promote further chemical bonding or cross-linking) that builds the properties of the pressure-sensitive adhesive to their final (e.g., end-use) state.

Regardless of whether pressure-sensitive adhesive layer 32 has achieved its final properties, substrate 30 is brought into contact with the major radially outer surface 11 of stencil roll 2 so that major adhesive surface 33 of PSA layer 32 becomes temporarily adhesively bonded to outer surface 11 of stencil roll 2. This can advantageously reduce any tendency for substrate 30 to slip relative to surface 11 of stencil roll 2, which can aid in the uniformity of particle deposition as discussed earlier. This adhesive bond will be broken to detach major adhesive surface 33 of PSA 32 from surface 11 of stencil roll 2 when it is desired to separate substrate 30 from stencil roll 2. The properties of PSA 32 may be advantageously chosen to allow such separation without damage to the PSA (as noted below, the outer surface 11 of stencil roll 2 may comprise release properties in aid of this).

Backing 31 of substrate 30 can be comprised of any suitable material, e.g. polyolefin, polyester, nylon, paper, cellophane and so on. Backing 31 can take any suitable form, whether e.g. a nonporous film or a porous web (e.g., a woven, non-woven, or knitted material). In some embodiments, backing 31 may be a release liner from which pressure-sensitive layer 32 may be separated. Thus, in such embodiments, a PSA layer 32 bearing flowable dry powder particles thereon can be separated from a release liner for use, rather than being used e.g. in lasting contact with a tape backing.

The composition of the backing and the PSA may be chosen depending e.g. on the conditions (temperature, humidity, etc.) in which the resulting product is to be used. It is noted that in the present context "adhesive bonding" and like terms specifically denote bonding by way of a pressure-sensitive adhesive mechanism and do not encompass e.g. bonding such as achieved solely by heat curing or photo-curing of non-pressure-sensitive adhesive materials, solely by evaporation of water or solvent, and so on. It may be advantageous to provide a release treatment or coating on outer surface 11 of stencil roll 2 (as noted above), in order that the PSA can be de-bonded from the outer surface of stencil roll without causing damage to the PSA and without leaving an unsuitable amount of adhesive residue on the outer surface of the stencil roll. Such a release treatment or coating may be chosen with particular regard to the composition and properties of the PSA that is used.

In some embodiments, the flowable dry powder particles may be polydisperse, e.g. with a coefficient of variation of particle size of at least about 100%. Such particles may be polydisperse as obtained; or, a population of desired polydispersity (e.g. a bimodal or higher-order modal population, e.g. with two or more readily identifiable major peaks in a particle-size distribution) may be obtained by mixing two or more particle size populations with each other.

In some embodiments, flowable dry powder particles 40 may include organic polymeric particles. In specific embodiments, such organic polymeric particles 40 may be comprised of relatively hydrophilic materials (e.g. hydroxypropylmethylcellulose, hydroxyethylcellulose, cellulose, poly (ethylene glycol), guar gum, xanthan gum, and so on), and may function e.g. as water-wettable or water-absorbent or water-swellable materials. In other specific embodiments such organic particles may be comprised of relatively hydrophobic materials such as e.g. various latex beads, poly (methylmethacrylate) or polystyrene beads, e.g. for various optical or chromatography applications. In general, any a flowable dry powder of any organic polymeric composition may be used, e.g. cellulose derivatives such as cellulose acetate, polyolefins such as polypropylene, polyethylene, and blends and copolymers thereof, and so on. Combinations and mixtures of any of these may be used.

In some embodiments, particles 40 may include any desired inorganic particles, e.g. mineral pigments or fillers, e.g. titania, calcium carbonate, talc, kaolin clay, barium sulfate, and so on. In particular embodiments inorganic particles 40 may include at least some solid spherical glass microspheres (e.g., beads), hollow glass bubbles, ceramic microspheres, or the like. In specific embodiments, such inorganic particles may be at least partially reflective (e.g., silver-coated), for use in applications involving reflectivity or retro-reflectivity. In particular embodiments, particles 40 may be chosen from any of the compositions, size ranges, and arrangements described in Patent Application Publication No. US 2015-0232646 to Walker, J R., and in PCT Patent Application Publication WO 2015/123526, which are incorporated by reference herein in their entirety for this purpose.

In specific embodiments, particles 40 may include carbon black, graphite, activated carbon and like materials, which may be used e.g. as sorbents, filtration media, reinforcing fillers, and so on. In other specific embodiments, particles 40 may include abrasive particles, of any suitable composition and grade. In some embodiments, particles 40 (of any suitable composition and size) may be used as spacers, e.g. temporary or permanent spaces, in laminating substrates together. In various embodiments, combinations and mixtures of inorganic particles and organic particles may be used.

Any suitable article may be produced that includes particles that are partially embedded on a substrate as described herein, for any purpose. In particular embodiments, two such articles may be joined together face to face to form a pouch or enclosure.

List of Exemplary Embodiments

Embodiment 1 is a method for adhesively bonding flowable dry powder particles to a moving substrate, the method comprising: dispersing flowable dry powder particles onto a major radially inner surface of a hollow, rotating stencil roll, contacting a pressure-sensitive adhesive major surface of a moving substrate with a major radially outer surface of the hollow, rotating stencil roll and temporarily adhesively attaching the pressure-sensitive adhesive major surface of the moving substrate to the major radially outer surface of the hollow, rotating stencil roll; as the substrate rotates with the stencil roll, allowing at least some flowable dry powder particles to pass through at least some apertures in the stencil roll so as to contact the pressure-sensitive adhesive major surface of the moving substrate and to be adhesively bonded thereto; and, allowing at least some flowable dry powder particles that have not adhesively bonded to the pressure-sensitive adhesive surface of the moving substrate to tumble freely along the major radially inner surface of the stencil roll as the stencil roll rotates; and, detaching the pressure-sensitive adhesive surface of the moving substrate from the outer surface of the hollow, rotating stencil roll so as to produce a substrate comprising an array of flowable dry powder particles attached to the pressure-sensitive adhesive major surface thereof.

Embodiment 2 is the method of embodiment 1 wherein the flowable dry powder particles that tumble freely along the major radially inner surface of the stencil roll as the stencil roll rotates, form a rolling bank as the stencil roll rotates.

Embodiment 3 is the method of any of embodiments 1-2 wherein the stencil roll further comprises at least one particle-contacting member that at least closely abuts the major radially inner surface of the rotating stencil roll but is not attached to the stencil roll so as to rotate congruently therewith, which member assists in dislodging flowable dry powder particles from the major radially inner surface of the stencil roll so that the particles can tumble freely along the major radially inner surface of the stencil roll. Embodiment 4 is the method of embodiment 3 wherein the particle-contacting member is in the form of at least one brush that comprises bristles that contact the major radially inner surface of the stencil roll, wherein the brush is mounted at an angular distance, along the direction of rotation of the stencil roll, of from about 30 degrees to about 100 degrees from a gravitationally lowest point of the stencil roll.

Embodiment 5 is the method of any of embodiments 1-4 wherein the major radially outer surface of the stencil roll is a release surface.

Embodiment 6 is the method of any of embodiments 1-5 wherein at least selected apertures of the stencil roll are configured so that flowable dry powder particles can pass through each selected aperture only one at a time, so that for each complete rotation of the stencil roll, only one flowable dry particle is passed through each selected aperture to be attached to the pressure-sensitive adhesive major surface of the substrate. Embodiment 7 is the method of any of embodiments 1-5 wherein at least selected apertures of the stencil roll are configured so that multiple dry powder particles can pass through each selected aperture at a time, so that for each complete rotation of the stencil roll, multiple flowable dry powder particles are passed through each selected aperture to be attached to the pressure-sensitive adhesive major surface of the substrate. Embodiment 8 is the method of any of embodiments 1-7 wherein at least selected apertures of the stencil roll each comprise a plurality of sub-apertures, at least selected sub-apertures being sized so as to allow at least one flowable dry powder particle to pass therethrough at a time, so that the method causes a plurality of flowable dry powder particles to be attached to the pressure-sensitive adhesive major surface of the substrate, as a nested array.

Embodiment 9 is the method of any of embodiments 1-8 wherein the stencil roll comprises a stencil shell that comprises a plurality of apertures extending therethrough, and wherein the apertures exhibit a radial length, on average, of from about 20 μm to about 4 mm.

Embodiment 10 is the method of embodiment 9 wherein the stencil shell is a cylindrical screen-printing screen with a hardened screen-printing emulsion patterned thereon, wherein the hardened emulsion comprises interior edges that define areas of the screen-printing screen that do not have hardened emulsion thereon, which areas of the screen-printing screen that do not have hardened emulsion thereon provide apertures of the stencil shell.

Embodiment 11 is the method of any of embodiments 1-10 wherein the pressure-sensitive adhesive major surface of the substrate is detached from the major radially outer surface of the stencil roll, at a location that is angularly within plus or minus 40 degrees from a gravitationally highest point of the stencil roll.

Embodiment 12 is the method of any of embodiments 1-1 wherein the apparatus comprises a backing roll that abuts the stencil roll to form a nip, and wherein the pressure-sensitive adhesive major surface of the substrate is detached from the major radially outer surface of the stencil roll, at a location that is angularly within plus or minus 40 degrees from the nip. Embodiment 13 is the method of any of embodiments 1-12 wherein the apparatus comprises a backing roll that abuts the stencil roll to form a nip, and wherein the pressure-sensitive adhesive major surface of the substrate is detached from the major radially outer surface of the stencil roll, at a location that is at least 90 degrees angularly from the nip along the direction of rotation of the stencil roll.

Embodiment 14 is the method of any of embodiments 1-13 wherein the dispensing of the flowable dry powder particles onto the radially inner major surface of the stencil roll comprises gravity-dropping the flowable dry powder particles onto the radially inner major surface of the stencil roll.

Embodiment 15 is the method of embodiment 14 wherein the gravity-dropping comprises allowing additional flowable dry powder particles to gravity-drop onto a loose mass of flowable dry powder particles located at least in a lowermost angular portion of the interior of the rotating stencil roll.

Embodiment 16 is the method of any of embodiments 1-15 wherein the flowable dry powder particles comprise partially reflective glass beads. Embodiment 17 is the method of any of embodiments 1-15 wherein the flowable dry powder particles comprise activated carbon particles. Embodiment 18 is the method of any of embodiments 1-17 wherein the flowable dry powder particles are present as a polydisperse mixture with a particle size coefficient of variation of at least about 100%.

Embodiment 19 is the method of any of embodiments 1-18 wherein less than about 10% by number of the flowable dry powder particles are attached to areas of the pressure-sensitive adhesive major surface of the substrate that had come into contact with the radially outer major surface of the stencil roll.

Embodiment 20 is the method of any of embodiments 1-19 wherein the substrate comprises a backing with a layer of pressure-sensitive adhesive disposed on a major surface thereof.

Embodiment 21 is the method of any of embodiments 1-20 wherein the stencil roll comprises a stencil shell comprising a plurality of apertures and wherein the apertures exhibit a diameter, on average, of from about 20 μm to about 4 mm.

EXAMPLES

Representative Example

A stencil roll was obtained for the patterning and deposition of flowable dry powder particles onto a continuously moving substrate bearing an exposed pressure-sensitive surface on one side of the substrate. The stencil roll was made to spec by Lebanon Valley Engraving (Lebanon, Pa.). As received, the stencil roll included a cylindrical nickel shell of approximately 20 cm in diameter. The thickness of the nickel shell was approximately 0.3 mm, with through-apertures being provided through the thickness of the shell in the patterns described below. Aluminum end rings and gears were mounted to each end of the stencil roll to provide structural support and to allow the stencil roll to be rotated at a desired speed. Lecithin Mold Release obtained from CRC Industries (Warminster, Pa.) was applied as an aerosol to the outer surface of the stencil roll. The stencil roll was installed into a continuous web-processing line obtained from Hirano Techseed, in a configuration generally similar to that depicted in FIG. 2.

The stencil as obtained from the vendor included seven different deposition aperture patterns. Each separate pattern occupied an area of approximately 75 mm×75 mm, and consisted of circular through-apertures in a square lattice, with the following approximate circle diameter/center-to-center spacing: 10/15 mm for Pattern 1, 5/7.5 mm for Pattern 2, 1/2 mm for Pattern 3, 0.5/1.5 mm for Pattern 4, 0.3/1.3 mm for Pattern 5, 0.2/1.2 mm for Pattern 6, and 0.1/1.1 mm for Pattern 7.

A continuous substrate comprising a polyethylene film backing bearing a pressure-sensitive adhesive on one major surface thereof was obtained from 3M Company under the trade designation 3104C. The substrate was threaded into the web-processing line so as to bring the adhesive surface of the substrate into contact with the outer surface of the stencil roll, at a line speed of approximately 3 m/min. Approximately 10 g of activated carbon (obtained from Kuraray and reported to have a mesh size of 32×60) flowable dry powder particles was inserted into the interior of the stencil roll (through an opening in one of the endcaps) in a single dose. As the stencil roll rotated, it was observed that these flowable dry powder particles tumbled freely and that the hold-up population formed a readily identifiable rolling bank. As the substrate followed its web path along the underside of the stencil roll and was then separated from the stencil roll, it was observed that dry powder particles had become adhesively bonded to the pressure-sensitive adhesive surface of the substrate, according to the deposition patterns described above. The exception was Pattern 7; in this particular case the combination of particle size and aperture size appeared to be such that few of the particles passed through the apertures to become bonded to the substrate.

Variations

Numerous variations of the above-described examples were performed. Some experiments used different substrates (e.g. the vinyl tape available from 3M company under the trade designation 3M Vinyl Tape 471; and, a film substrate bearing a pressure-sensitive adhesive of the general type available in products available from 3M Company under the trade designation Tegaderm). Some experiments used different release coatings (e.g., the release coating available from Nanoplas under the trade designation NanoMold QC15). Also, experiments were performed using a variety of flowable dry powder particles. These included hydroxypropyl methyl cellulose particles, guar gum particles, and glass beads. A wide variety of particle sizes were also used. In general, with a smaller ratio of aperture diameter to particle size, fewer particles were observed to pass through each aperture to become bonded to the pressure-sensitive adhesive. With a larger ratio of aperture diameter to particle size, more particles were observed to pass through each aperture to become bonded to the adhesive.

Other examples were performed which, although using a substrate that was heated in order to soften a surface of the substrate so that flowable dry powder particles could be attached thereto rather than using a substrate with a PSA, further demonstrated the breadth of particle types and sizes and deposition patterns that can be used in depositing flowable dry powder particles onto a substrate using the apparatus and methods disclosed herein. Some of these other examples are disclosed in U.S. Provisional Patent Application No. 62/269,725, entitled APPARATUS AND PROCESS FOR DEPOSITING DRY POWDER PARTICLES ONTO SUBSTRATES, filed evendate with the present application, and which is incorporated by reference in its entirety herein.

The foregoing Examples have been provided for clarity of understanding only, and no unnecessary limitations are to be understood therefrom. The tests and test results described in the Examples are intended to be illustrative rather than predictive, and variations in the testing procedure can be expected to yield different results. All quantitative values in the Examples are understood to be approximate in view of the commonly known tolerances involved in the procedures used.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). Although various theories and possible mechanisms may have been discussed herein, in no event should such discussions serve to limit the claimable subject matter. To the extent that there is any conflict or discrepancy between this specification as written and the disclosure in any document incorporated by reference herein, this specification as written will control.

What is claimed is:

1. A method for adhesively bonding flowable dry powder particles to a moving substrate, the method comprising:

dispersing flowable dry powder particles onto a major radially inner surface of a hollow, rotating stencil roll, contacting a pressure-sensitive adhesive major surface of a moving substrate with a major radially outer surface of the hollow, rotating stencil roll and temporarily adhesively attaching the pressure-sensitive adhesive major surface of the moving substrate to the major radially outer surface of the hollow, rotating stencil roll;

as the substrate rotates with the stencil roll, allowing at least some flowable dry powder particles to pass through at least some apertures in the stencil roll so as to contact the pressure-sensitive adhesive major surface of the moving substrate and to be adhesively bonded thereto; and, allowing at least some flowable dry powder particles that have not adhesively bonded to the pressure-sensitive adhesive surface of the moving substrate to tumble freely along the major radially inner surface of the stencil roll as the stencil roll rotates;

and, detaching the pressure-sensitive adhesive surface of the moving substrate from the outer surface of the hollow, rotating stencil roll so as to produce a substrate comprising an array of flowable dry powder particles attached to the pressure-sensitive adhesive major surface thereof, wherein the flowable dry powder particles consist of inorganic particles.

2. The method of claim 1 wherein the flowable dry powder particles that tumble freely along the major radially inner surface of the stencil roll as the stencil roll rotates, form a rolling bank as the stencil roll rotates.

3. The method of claim 1 wherein the stencil roll further comprises at least one particle-contacting member that at least closely abuts the major radially inner surface of the rotating stencil roll but is not attached to the stencil roll so as to rotate congruently therewith, which member assists in dislodging flowable dry powder particles from the major radially inner surface of the stencil roll so that the particles can tumble freely along the major radially inner surface of the stencil roll.

4. The method of claim 3 wherein the particle-contacting member is in the form of at least one brush that comprises bristles that contact the major radially inner surface of the stencil roll, wherein the brush is mounted at an angular distance, along the direction of rotation of the stencil roll, of from about 30 degrees to about 100 degrees from a gravitationally lowest point of the stencil roll.

5. The method of claim 1 wherein the major radially outer surface of the stencil roll is a release surface.

6. The method of claim 1 wherein at least selected apertures of the stencil roll are configured so that flowable dry powder particles can pass through each selected aperture only one at a time, so that for each complete rotation of the stencil roll, only one flowable dry particle is passed through each selected aperture to be attached to the pressure-sensitive adhesive major surface of the substrate.

7. The method of claim 1 wherein at least selected apertures of the stencil roll are configured so that multiple dry powder particles can pass through each selected aperture at a time, so that for each complete rotation of the stencil roll, multiple flowable dry powder particles are passed through each selected aperture to be attached to the pressure-sensitive adhesive major surface of the substrate.

8. The method of claim 1 wherein at least selected apertures of the stencil roll each comprise a plurality of sub-apertures, at least selected sub-apertures being sized so as to allow at least one flowable dry powder particle to pass therethrough at a time, so that the method causes a plurality of flowable dry powder particles to be attached to the pressure-sensitive adhesive major surface of the substrate, as a nested array.

9. The method of claim 1 wherein the stencil roll comprises a stencil shell that comprises a plurality of apertures extending therethrough, and wherein the apertures exhibit a radial length, on average, of from about 20 μm to about 4 mm.

10. The method of claim 9 wherein the stencil shell is a cylindrical screen-printing screen with a hardened screen-printing emulsion patterned thereon, wherein the hardened emulsion comprises interior edges that define areas of the screen-printing screen that do not have hardened emulsion thereon, which areas of the screen-printing screen that do not have hardened emulsion thereon provide apertures of the stencil shell.

11. The method of claim 1 wherein the pressure-sensitive adhesive major surface of the substrate is detached from the major radially outer surface of the stencil roll, at a location that is angularly within plus or minus 40 degrees from a gravitationally highest point of the stencil roll.

12. The method of claim 1 wherein the apparatus comprises a backing roll that abuts the stencil roll to form a nip, and wherein the pressure-sensitive adhesive major surface of the substrate is detached from the major radially outer surface of the stencil roll, at a location that is angularly within plus or minus 40 degrees from the nip.

13. The method of claim 1 wherein the apparatus comprises a backing roll that abuts the stencil roll to form a nip, and wherein the pressure-sensitive adhesive major surface of the substrate is detached from the major radially outer surface of the stencil roll, at a location that is at least 90 degrees angularly from the nip along the direction of rotation of the stencil roll.

14. The method of claim 1 wherein the dispensing of the flowable dry powder particles onto the radially inner major surface of the stencil roll comprises gravity-dropping the flowable dry powder particles onto the radially inner major surface of the stencil roll.

15. The method of claim 14 wherein the gravity-dropping comprises allowing additional flowable dry powder particles to gravity-drop onto a loose mass of flowable dry powder particles located at least in a lowermost angular portion of the interior of the rotating stencil roll.

16. The method of claim 1 wherein the flowable dry powder particles comprise partially reflective glass beads.

17. The method of claim 1 wherein the flowable dry powder particles are present as a polydisperse mixture with a particle size coefficient of variation of at least about 100%.

18. The method of claim 1 wherein less than about 10% by number of the flowable dry powder particles are attached to areas of the pressure-sensitive adhesive major surface of the substrate that had come into contact with the radially outer major surface of the stencil roll.

19. The method of claim 1 wherein the substrate comprises a backing with a layer of pressure-sensitive adhesive disposed on a major surface thereof.

20. The method of claim 1 wherein the stencil roll comprises a stencil shell comprising a plurality of apertures and wherein the apertures exhibit a diameter, on average, of from about 20 μm to about 4 mm.

* * * * *